US005093017A

United States Patent [19]

Andress et al.

[11] Patent Number: 5,093,017

[45] Date of Patent: Mar. 3, 1992

[54] REACTION PRODUCTS OF OLEFINS, SULFUR, ALIPHATIC AMINE, ALKYLENE OXIDE, PHOSPHORUS PENTASULFIDE, AND PHOSPHORUS PENTOXIDE AND LUBRICANT COMPOSITIONS THEREOF

[75] Inventors: Harry J. Andress, Wenonah; Henry Asnjian, E. Brunswick, both of N.J.

[73] Assignee: Mobile Oil Corporation, Fairfax, Va.

[21] Appl. No.: 488,581

[22] Filed: Mar. 5, 1990

Related U.S. Application Data

[63] Continuation-in-part of Ser. No. 907,241, Sep. 15, 1986, Pat. No. 4,906,391.

[51] Int. Cl.[5] ..... C10M 137/00; C10M 137/14

[52] U.S. Cl. ..... 252/46.7; 568/13

[58] Field of Search ..... 252/46.7

[56] References Cited

U.S. PATENT DOCUMENTS

| | | | |
|---|---|---|---|
| 3,389,086 | 6/1968 | Reed et al. | 252/46.7 |
| 3,459,662 | 8/1969 | Hu et al. | 252/46.7 |
| 4,212,753 | 7/1980 | Horodysky | 252/46.7 |
| 4,521,318 | 6/1985 | Karol | 252/46.7 |
| 4,717,491 | 1/1988 | Cardis | 252/46.7 |
| 4,744,912 | 5/1988 | Cardis | 252/46.7 |
| 4,814,097 | 3/1989 | Cardis | 252/46.7 |
| 4,906,391 | 3/1990 | Andress | 252/46.6 |

*Primary Examiner*—Prince Willis, Jr.
*Assistant Examiner*—Jerry D. Johnson
*Attorney, Agent, or Firm*—Alexander J. McKillop; Charles J. Speciale; Howard M. Flournoy

[57] ABSTRACT

The reaction product of olefin, sulfur, aliphatic amine, alkylene oxide, phosphorus pentasulfide, and phosphorus pentoxide provides an effective antiwear additive agent for lubricating oils.

18 Claims, No Drawings

REACTION PRODUCTS OF OLEFINS, SULFUR, ALIPHATIC AMINE, ALKYLENE OXIDE, PHOSPHORUS PENTASULFIDE, AND PHOSPHORUS PENTOXIDE AND LUBRICANT COMPOSITIONS THEREOF

CROSS-REFERENCE TO RELATED APPLICATIONS

This is a continuation-in-part application of copending application, Ser. No. 907,241, filed Sept. 15, 1986, now U.S. Pat. No. 4,906,391 and entitled REACTION PRODUCTS OF OLEFINS, SULFUR AND PHOSPHORUS PENTASULFIDE AND LUBRICANT COMPOSITIONS THEREOF.

BACKGROUND OF THE INVENTION

This application relates to phosphorosulfide-containing compounds made by reacting olefins with phosphorus pentasulfide, phosphorus pentoxide, sulfur, and/or a sulfur-containing compound and an aliphatic amine and an alkylene oxide.

The use of phosphorus compounds as load-carrying or antiwear agents and lubricant compositions is well known. The use of organic phosphorus compounds in combination with, for example, hindered phenols, is known from U.S. Pat. No. 3,115,465. It is also well known to use sulfurized olefins as lubricant additives as shown, for example, in U.S. Pat. Nos. 4,194,980 and 4,240,948.

U.S. Pat. No. 4,152,275 discloses olefin/sulfur/ phosphorus lubricant additives formed by the reaction of sulfurized olefins and phosphorodithoic acids. U.S. Pat. No. 4,402,259 discloses metal salts of phosphorosulfurized hydrocarbons and lubricant compositions containing same. As far as applicant is aware, however, no art exists which suggests the herein-disclosed reaction product of olefins, phosphorus pentasulfide, sulfur and/or hydrogen sulfide.

SUMMARY OF THE INVENTION

The present invention is directed to lubricant compositions comprised of oils of lubricating viscosity and greases prepared therefrom containing minor amounts of highly effective antiwear additive products prepared by reacting olefins, elemental sulfur (with or without added $H_2S$) and phosphorus pentasulfide ($P_2S_5$), phosphorus pentoxide ($P_2O_5$), an aliphatic amine and/or a alkylene oxide and to the reaction products themselves. Accordingly, it is an object of this invention to provide improved lubricant compositions and more specifically antiwear lubricant compositions.

DESCRIPTION OF PREFERRED EMBODIMENTS

In general the olefin-sulfur-phosphorus pentasulfide reaction takes place at temperatures of up to about 150° C., preferably from about 50° to 120° C. in molar ratios of sulfur to olefin of from about 1:2 to about 2:1 to about 0.1 to about 1 mole of phosphorus pentasulfide. The phosphorus pentasulfide, phosphorus pentoxide and aliphatic amine are generally reacted in substantially equimolar amounts. Although the reaction may take place in any suitable sequence the olefin, sulfur, sulfur-containing compound and phosphorus pentasulfide are preferably first reacted and the mixture is then cooled down to about 25° to 50° C. and the alkylene oxide, aliphatic amine and phosphorus pentoxide are added to the reaction mixture. The reaction may take place with or without added $H_2S$. When $H_2S$ is added the molar quantity of elemental sulfur to $H_2S$ may vary from about 1:1 to about 2:1. Generally speaking, the pressure is autogenous and the time of reaction may vary from about 4 to about 16 and preferably 12 hours or less.

Any suitable olefin may be used. A $C_2$ to about a $C_{32}$ olefin or higher are highly suitable. Preferred are $C_3$-$C_6$ olefins with $C_4$ being more preferred and isobutylene most preferred.

The additives prepared in accordance herewith are effective in the standard conventional amounts usually used, that is, comprising from about 0.01 to about 5% by weight (usually no more than about 10 wt. %) of the total composition; with the lubricant or other oleaginous media comprising the remainder of the composition along with any other additives normally used in such compositions, such as other extreme pressure or antiwear agents, viscosity control agents, detergents and antioxidants.

This application in its preferred embodiments is directed to lubricant compositions comprising a major amount of an oil of lubricating viscosity, or greases prepared therefrom and a minor amount of the hereindescribed additives sufficient to improve the aforementioned antiwear properties of said lubricant compositions.

The compositions hereof may comprise any oleaginous materials that require lubricative properties under extreme pressure/antiwear conditions and therefore require protection against excessive wear under operating conditions. Especially suitable for use with the additives of this invention are liquid hydrocarbon oils of lubricating viscosity. Lubricant oils, improved in accordance with the present invention, may be of any suitable lubricating viscosity. In general the lubricant compositions may comprise any mineral or synthetic oil of lubricating viscosity. The additives of this invention are especially useful in greases and in automotive fluids such as brake fluids, and power brake fluids, transmission fluids, power steering fluids, various hydraulic fluids and gear oils.

In instances where synthetic oils are desired in preference to refined petroleum or mineral oils they may be employed alone or in combination with a mineral oil. They may also be used as the vehicle or base of grease compositions. Typical synthetic lubricants include polyisobutylene, polybutenes, hydrogenated polydecenes, polypropylene glycol, polyethylene glycol, trimethylolpropane esters, neopentyl and pentaerythritol esters of carboxylic acids, di(2-ethylhexyl) sebacate, di(2-ethylhexyl) adipate, dibutyl phthalate, luorocarbons, silicate esters, silanes, esters of phosphorus-containing acids, liquid ureas, ferrocene derivatives, hydrogenated mineral oils, chain-type polyphenols, siloxanes and silicones(polysiloxanes), alkyl-substituted diphenyl ethers typified by a butyl-substituted bis(p-phenoxy phenyl) ether, phenoxy phenylethers, dialkylbenzenes, etc.

As hereinbefore indicated, the aforementioned additives can be incorporated as additives in grease compositions. When high temperature stability is not a requirement of the finished grease, mineral oils having a viscosity of at least 40 SSU at 150° F. are useful. Otherwise those falling within the range of from about 60 SSU to about 6,000 SSU at 100° F. may be employed. The lubricating compositions of the improved greases of the present invention, containing the above-described additives, are combined with a grease-forming quantity of thickening agent. For this purpose, a wide variety of materials can be dispersed in the lubricating oil in grease-forming quantities in such degree as to impart to the resulting grease composition the desired consistency. Exemplary of the thickening agents that may be employed in the grease formulation are metal soaps as well as non-soap thickeners, such as surface-modified clays and silicas, aryl ureas, calcium complexes and similar materials. In general, grease thickeners are employed which do not melt or dissolve when used at the required temperature within a particular environment; however, in all other respects, any material which is normally employed for thickening or gelling oleaginous fluids or forming greases may be used in the present invention.

The following examples are intended to exemplify the hereinembodied invention and in no way limit the scope thereof.

EXAMPLE 1

A mixture of 56 grams (1 mol) of isobutylene, 64 grams (2 mols) of sulfur and 22.2 grams (0.1 mol) of phosphorus pentasulfide was charged to an autoclave. The temperature was raised to about 100° C. and held for twelve hours. The final product was obtained by filtration.

EXAMPLE 2

A mixture of 192 grams (6 mols) of sulfur, 20.4 grams (0.6 mols) hydrogen sulfide, 111 grams (0.5 mol) phosphorus pentasulfide, and 672 grams (12 mols) isobutylene was charged to an autoclave. The temperature was raised to about 110° C. and held for twelve hours. The final product was obtained by filtration.

EXAMPLE 3

A mixture of 352 grams (11 mols) of sulfur, 122 grams (0.5 mol) of phosphorus pentasulfide, 560 grams (10 mols) of isobutylene, and 170 grams (5 mols) of hydrogen sulfide was charged to an autoclave. The temperature was raised to about 120° C. and held for twelve hours. The reaction mixture was cooled to about 25° C. and 80 grams (1.2 mols) propylene oxide was added. The mixture was then stirred for about ten hours at 50° C., followed by the addition of 57 grams (0.4 mol) of phosphorus pentoxide. After stirring the reaction mixture for eight hours at 50° C., 80 grams (0.4 mol) Primene 81R, a commercially available product believed to be a mixture of primary aliphatic amines in which the aliphatic moiety is predominantly $C_{12}$ and $C_{14}$ tertiary alkyl groups, was added and stirred for two hours at 50° C. The final product was obtained by filtration.

A fully formulated solvent refined paraffinic mineral oil was subjected to the standard Four-Ball Wear Test for determining improvement in antiwear properties. This test is described, for example, in U.S. Pat. No. 3,423,316. In general, in this test, three steel balls of 52100 steel are held fixed in a ball cup. The test lubricant is added to the ball cup and acts as a lubricant. A similar fourth ball positioned on a rotatable vertical spindle is brought into contact with the three balls and is rotated against them for a known time. The force with which the fourth ball is pressed against the three stationary balls may be varied to give a desired load. The temperature of the ball cup, stationary balls and lubricant may be brought to a desired temperature and held constant during the test. At the end of the test, the three stationary steel balls are examined for wear-scar diameter. The extent of scarring represents the antiwear effectiveness of the lubricant; the smaller the wear scar at the same load, speed, temperature and time, the more effective the antiwear characteristics of the lubricant. In the data of Table 1 are shown the results obtained in which the aforementioned base stock oil was subjected to the Four-Ball Wear Test.

TABLE 1

| Compound | Conc. Wt. % | Temp °F. | Scar Diameter, mm Speed (RPM) 500 | 1000 | 1500 | 2000 |
|---|---|---|---|---|---|---|
| Base Oil | — | 200 | 0.6 | 1.06 | 1.35 | 2.23 |
| | | 390 | 1.0 | 1.31 | 2.08 | — |
| + Example 1 | 1.0 | 200 | 0.4 | 0.4 | 0.5 | 0.5 |
| | | 390 | 0.5 | 0.5 | 0.55 | 0.7 |
| + Example 2 | 1.0 | 200 | 0.4 | 0.45 | 0.5 | 0.6 |
| | | 390 | 0.5 | 0.55 | 0.6 | 0.7 |
| + Example 3 | 1.0 | 200 | 0.4 | 0.4 | 0.5 | 0.5 |
| | | 390 | 0.4 | 0.4 | 0.5 | 0.6 |

The data of the Table is indicative of the improvement in the art obtained as a result of the present invention.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

We claim:

1. A lubricant composition comprising (1) a major proportion of an oil of lubricating viscosity or grease prepared therefrom and (2) a minor antiwear amount of the reaction product of a C2 to C32 olefin, phosphorus pentasulfide, phosphorus pentoxide, aliphatic amine, alkylene oxide and a source of sulfur selected from the group consisting of elemental sulfur and a mixture of elemental sulfur with H2S wherein the molar ratio of elemental sulfur to H2S in said mixture is about 1:1 to 2:1, said reaction product produced by the process of reacting under autogenous pressure for about 4 to about 16 hours at a temperature of about 25° C. to about 120° C.; olefin, sulfur source and phosphorus pentasulfide in a molar ratio of about 1:2:0.1 to about 2:1:1, phosphorus pentoxide, aliphatic amine and alkylene oxide in a molar ratio of about 1:1:1 and wherein the molar ratio of phosphorus pentasulfide to phosphorus pentoxide in said reacting is approximately 1:1.

2. The composition of claim 1 wherein the product is formed without $H_2S$.

3. The composition of claim 1 wherein the product is formed with $H_2S$.

4. The composition of claim 2 wherein said olefin, elemental sulfur and phosphorus pentasulfide are reacted in about 1:1:0.1–0.5 molar ratios.

5. The composition of claim 2 wherein the ratio of said olefin, elemental sulfur and phosphorus pentasulfide are reacted in about a 1:1:0.1 molar ratio.

6. The composition of claim 3 wherein said olefin, sulfur+$H_2S$ and phosphorus pentasulfide are reacted in about a 1:1:0.5 molar ratio.

7. The composition of claim 1 wherein said olefin is a $C_2$ to about a $C_8$ olefin.

8. The composition of claim 7 wherein said olefin is a $C_4$ olefin.

9. The composition of claim 8 wherein said olefin is isobutylene.

10. The composition of claim 1 wherein the oil of lubricating viscosity is selected from the group consisting of mineral, synthetic and mixtures of mineral and synthetic oils.

11. The composition of claim 10 wherein the oil of lubricating viscosity is a mineral oil.

12. The composition of claim 10 wherein the oil of lubricating viscosity is a synthetic oil.

13. The composition of claim 1 wherein said major proportion is a grease.

14. An antiwear lubricant additive comprising the reaction product of a C2 to C32 olefin, phosphorus pentasulfide, phosphorus pentoxide, aliphatic amine, alkylene oxide and a source of sulfur selected from the group consisting of elemental sulfur and a mixture of elemental sulfur with H2S wherein the molar ratio of elemental sulfur to H2S in said mixture is about 1:1 to 2:1, said reaction product produced by the process of reacting under autogenous pressure for about 4 to about 16 hours at a temperature of about 25° C. to about 120° C.; olefin, sulfur source and phosphorus pentasulfide in a molar ratio of about 1:2:0.1 to about 2:1:1, phosphorus pentoxide, aliphatic amine and alkylene oxide in a molar ratio of about 1:1:1 and wherein the molar ratio of phosphorus pentasulfide to phosphorus pentoxide in said reacting is approximately 1:1.

15. The product of claim 14 wherein said product is formed without $H_2S$.

16. The product of claim 14 wherein said product is formed with $H_2S$.

17. The product of claim 16 wherein the mole ratio of $H_2S$ to sulfur is about 1:1.

18. The product of claim 16 wherein the mole ratio of $H_2S$ to sulfur is about 1:2.

* * * * *